US010531521B2

(12) United States Patent
Korkusuz et al.

(10) Patent No.: US 10,531,521 B2
(45) Date of Patent: Jan. 7, 2020

(54) SPECIFIC HEATER CIRCUIT TRACK PATTERN COATED ON A THIN HEATER PLATE FOR HIGH TEMPERATURE UNIFORMITY

(71) Applicant: ASELSAN ELEKTRONIK SANAYI VE TICARET ANONIM SIRKETI, Ankara (TR)

(72) Inventors: Nuri Gokhan Korkusuz, Ankara (TR); Birce Gulec Boyaci, Ankara (TR)

(73) Assignee: ASELSAN ELEKTRONIK SANAYI VE TICARET ANONIM SIRKETI, Ankara (TR)

( * ) Notice: Subject to any disclaimer, the term of this patent is extended or adjusted under 35 U.S.C. 154(b) by 390 days.

(21) Appl. No.: 15/505,114

(22) PCT Filed: Aug. 27, 2014

(86) PCT No.: PCT/IB2014/064086
§ 371 (c)(1),
(2) Date: Feb. 20, 2017

(87) PCT Pub. No.: WO2016/030719
PCT Pub. Date: Mar. 3, 2016

(65) Prior Publication Data

US 2019/0159295 A1 May 23, 2019

(51) Int. Cl.

| | |
|---|---|
| ***H05B 3/00*** | (2006.01) |
| ***H05B 3/74*** | (2006.01) |
| ***H05B 3/26*** | (2006.01) |
| ***H05B 3/68*** | (2006.01) |

(52) U.S. Cl.
CPC ..... *H05B 3/748* (2013.01); *H05B 3/265* (2013.01); *H05B 3/68* (2013.01); *H05B 2203/005* (2013.01); *H05B 2203/013* (2013.01); *H05B 2203/015* (2013.01)

(58) Field of Classification Search
CPC . H05B 3/16; H05B 3/68; H05B 3/748; H05B 2203/013; H05B 2203/015
USPC ..... 219/443.1, 383, 538, 539, 461.1
See application file for complete search history.

(56) References Cited

U.S. PATENT DOCUMENTS

| | | | | |
|---|---|---|---|---|
| 5,294,778 | A * | 3/1994 | Carman | H01L 21/67103 118/725 |
| 6,222,166 | B1 | 4/2001 | Lin et al. | |
| 7,057,140 | B2 | 6/2006 | Pittman | |
| 2004/0074893 | A1 | 4/2004 | Wermbter et al. | |

(Continued)

*Primary Examiner* — Dana Ross
*Assistant Examiner* — Ayub A Maye
(74) *Attorney, Agent, or Firm* — Gokalp Bayramoglu

(57) ABSTRACT

A heater circuit track pattern designed to be coated on a heater plate in order to achieve high uniform heat distribution and fast heating up, low power consumption and prevent current crowding with high fill factor. The heater plate includes a substrate layer which is an electrically insulative, highly thermally conductive, low heat capacity substrate where the heater circuit track pattern has a conductive layer and a resistive layer. The conductive layer has conductive parts such that power pads, main power lines, electrical transfer pads, sub-conductor lines are formed by a highly conductive material to distribute power equally to the resistive layer. The resistive layer has resistive portions including resistive parts formed by a resistive ink to heat up the heater plate.

20 Claims, 3 Drawing Sheets

(56) References Cited

U.S. PATENT DOCUMENTS

| | | | | |
|---|---|---|---|---|
| 2004/0238525 | A1 | 12/2004 | Wermbter et al. | |
| 2005/0029244 | A1* | 2/2005 | Ito | C04B 35/00 219/444.1 |
| 2008/0017632 | A1* | 1/2008 | Maki | H01L 21/67103 219/543 |

* cited by examiner

SPECIFIC HEATER CIRCUIT TRACK PATTERN COATED ON A THIN HEATER PLATE FOR HIGH TEMPERATURE UNIFORMITY

CROSS REFERENCE TO RELATED APPLICATIONS

This application is the national phase of International Application No PT/IB2014/064086 filed on 27 Aug. 2014, the entire contents of which are incorporated herein by reference.

FIELD OF THE INVENTION

The invention relates to a heater circuit track pattern designed to be coated on a heater plate for highly uniform heat distribution and fast heating up.

BACKGROUND OF THE INVENTION

Typically, thick film heaters are composed of four main layers; a metallic substrate, an insulating layer, a resistive layer coated on the insulating layer and an overglaze layer. For some specific applications, it is very important to heat the plate in a very short time with high temperature uniformity. To meet these requirements, the track pattern needs to be designed with special care.

Achieving high temperature uniformity and short heating up time with limited power consumption in a heater is related with the construction materials properties such as thermal conductivity, thermal expansion coefficient, specific heat and density. So, heater plate constructors try to combine different construction materials in order to diminish their interrelated obstacles.

In many heating plate designs, an additional layer has to be applied to eliminate. various disadvantages of using substrates. In the U.S. Pat. No. 6,222,166, heating plate uses aluminum substrate due to its exceptional thermal conductivity and uniform heat distribution characteristics. Since the substrate has a very high thermal expansion coefficient, an insulator layer is applied over the substrate. However, it is important to note that proposed additional layers result in high heat capacity due to increased mass and volume which is not favorable regarding power consumption and required time to reach desired temperatures. The increased mass and volume also make the heater plate not appropriate for some low volume applications.

Moreover, an ideal heater plate has to have compact track pattern of resistive layer in order to reduce the volume and the power consumption. However, tight turns of the resistive track pattern causes non-homogenous distribution of current density through the pattern called "current crowding" phenomenon. Non-homogenous distribution of current density can lead to localized overheating and formation of thermal hot spots. In some extreme cases it is leading to a vicious circle like thermal runaway. The rising temperature can also leads to localized thermal expansion on the material. As a result of localized thermal expansion, a big stress occurs at the joint parts and some cracks emerge or split apart at the joint which also causes short circuits.

SUMMARY OF THE INVENTION

The aim of this invention is accomplishing to construct a heater plate which eliminates the current crowding problem, has high fill factor, has short warm up time with low power consumption in a limited volume. A track pattern comprising a conductive layer and a resistive layer is coated on a substrate. The design of the track pattern is carried carefully to prevent overheating of the inside of the resistive layer and conductive layer bends to distribute power equally to the resistive layer.

BRIEF DESCRIPTION OF DRAWINGS

A heater circuit track pattern designed to be coated on a heater plate in order to achieve high uniform heat distribution and fast heating up is illustrated in the attached figures, where.

Figure 1:
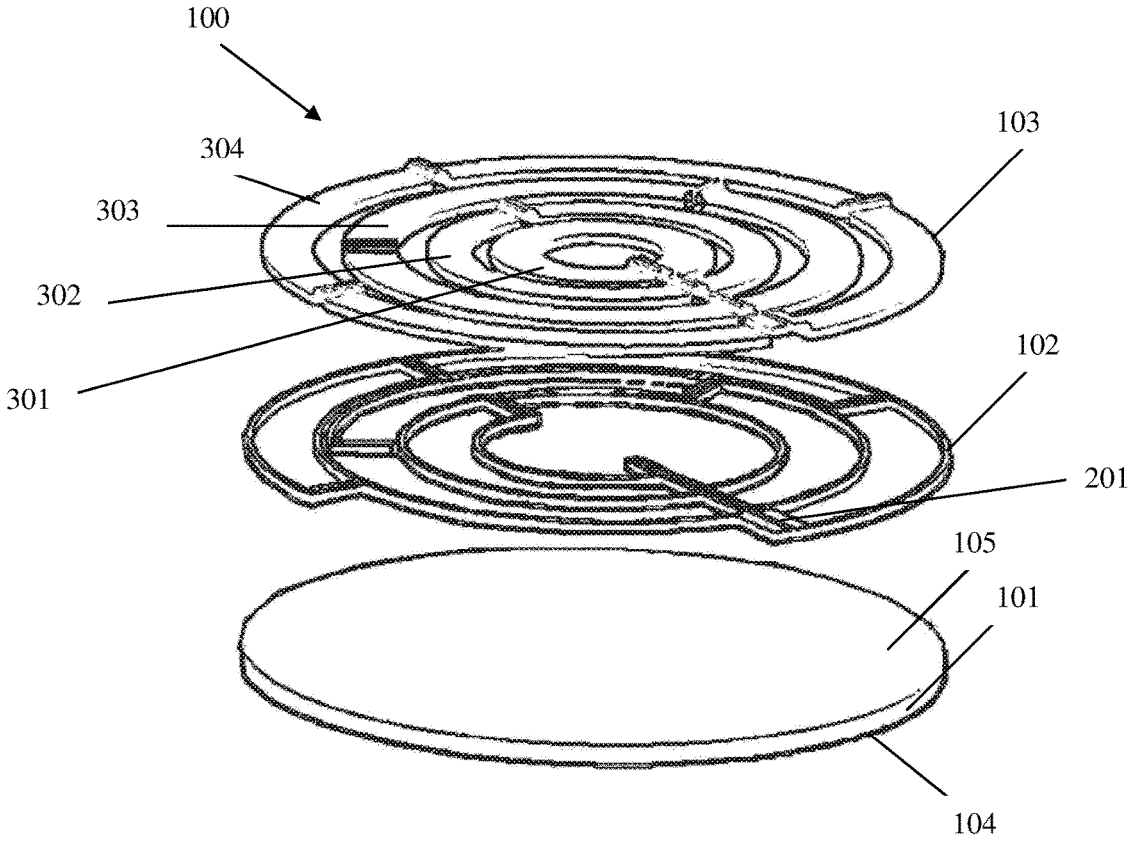
FIG. 1. The exploded view of the heater in accordance with the invention.

The elements illustrated in the figures are numbered as follows:

100. Heater plate
101. Substrate layer
102. Conductive layer
103. Resistive layer
104. Critical heating surface
105. Heating circuit surface
201. Power pad
202. Main power line
203. Electrical transfer pad
204. Sub-conductor lines
205. Resistive transfer pad
301. First portion resistive part
302. Second portion resistive part
303. Third portion resistive part.
304. Fourth portion resistive part
α. 360°−Δθ
β. 180°−Δθ
Y. 120°−Δθ
Z. 90−Δθ

DETAILED DESCRIPTION OF THE INVENTION

A heater circuit track pattern designed to be coated on a substrate in order to achieve high uniform heat distribution and fast heating up, low power consumption and prevent current crowding with high fill factor, low volume heater, plate 100 comprising;

- a substrate layer 101, the bottom layer of the heater plate 100, which is electrically insulative, thermally high conductive, low heat capacity substrate having the critical heating surface 104 on one side and heating circuit surface 105 on the other side where the heater circuit track pattern having a conductive layer 102 and a resistive layer 103 is coated,
- a conductive layer 102, coated on the heating circuit surface 105, having conductive parts such that power pads 201, main power lines 202, electrical transfer pads 203, sub-conductor lines 204 formed by a high conductive material to distribute power equally to the resistive layer 103,
- a resistive layer 103, coated on the heating circuit surface 105 after the conductive layer 102 is coated, having resistive portions comprising resistive parts formed by a resistive ink to heat up the heater plate 100 providing high uniform heat distribution, low heating up time, low power requirements, high fill factor and preventing current crowding phenomenon power pads 201 through which power is applied to the heater plate 100, the main power lines 202 providing power to the heater plate 100 via connecting power pads 201 to the sub-conductor lines 204, the electrical transfer pads 203 that is a connector which electrically connects the conductive layer 102 and resistive layer 103 through resistive layer 103 section resistive transfer pads 205, sub-conductor lines 204 that is a connector which connects the electrical transfer pads 203 to power pads 201 through the min power lines 202.

resistive transfer pads 205 that is a connector which connects the electrical transfer pads 203 to resistive parts of the resistive layer 103, first resistive portion comprising a first portion resistive part 301 with an angle $\alpha=360°-\Delta\theta$, second resistive portion encircling the first resistive portion, comprising two second portion resistive parts 302 with an angle $\beta=180°-\Delta\theta$.

third resistive portion encircling the second resistive portion, comprising three third portion resistive parts 303 with an angle $Y=120°-\Delta\theta$ fourth resistive portion encircling the third resistive portion, comprising four, fourth potion resistive parts 304, two of which have an angle of $\zeta=90°-\Delta\theta$ and the other two of which have a little bit smaller angle $\zeta 90°-\Delta\theta$ due to power pads 201 spacing, resistances of the resistive parts are arranged by adjusting the widths to equalize power densities.—main power lines 202, electrical transfer pads 203, sub-conductor lines 204 connect each resistive part to power pads 201, resulting in a complex combination with resistive parts and of conductive layer 102 sections with small resistivity.

a complex combination with resistive parts and of conductive parts provide ±4.5° C. temperature difference across the critical heating surface at 205° C. average temperature.

a complex combination with resistive parts and of conductive parts provide %76 fill factor.

resistances of the conductive parts are also included during heater circuit track pattern optimization to benefit from their resistances for heating up.

The present invention is proposed to ensure high thermal uniformity on the critical heating surface 104 of a heater plate 100 with low power consumption in a limited volume. Moreover, it provides fast heating up. In addition to relying on the thermal properties of the substrate layer 101, the most importantly, the present invention uses a specific heater circuit pattern for critical heating surface's 104 heat isotropy. A track pattern comprising a conductive layer and a resistive layer is coated on a substrate. The design of the track pattern is carried carefully to prevent overheating of the inside of the resistive layer and conductive layer bends to distribute power equally to the resistive layer.

The heater plate 100 has two main parts; a substrate layer 101 and a circuit track pattern composed of a conductive layer 102 and a resistive layer 103. The substrate layer 101 is the bottom layer which is an electrically insulative substrate. Top surface of the substrate layer 101 is called heating circuit surface 105 and base surface of the substrate layer 101 is called critical heating surface 104. The substrate layer 101 should be an appropriate substrate, preferably a ceramic substrate such as aluminum nitride, such that there is no need for additional layers, neither to achieve temperature uniformity nor to compensate the problems due to some other substrate types. Any thermally high conductive and low heat capacity materials can be used to achieve this kind of substrate layer 101. The circuit track pattern is a heating circuit, composed of conductive layer 102 and the resistive layer 103, generating heat. The substrate layer 101 should transfer generated heat to the critical heating surface 104 from heating circuit surface 105. That is why the substrate layer 101 has to be made from high thermal conductive materials.

The circuit track pattern is composed of a conductive layer 102 and a resistive layer 103. The circuit track pattern is coated on the heating circuit surface 105 by the thick film technology. Since the circuit track pattern consists of coatings, the total volume of the design is highly reduced, mostly defined by the substrate 101 thickness. The design of the track pattern is carried carefully to prevent overheating of the inside of the resistive layer 103 and conductive layer 102 bends.

The first layer coated on heating circuit surface 105 is the conductive layer 102. The main purpose of the conductive layer 102 is to distribute the electrical power to the resistive layer 103. Therefore, the conductive layer 102 should be made from an electrically and thermally high conductive material, preferably Au. The conductive layer 102 consists of four sections; power pads 201, main power line 202, electrical transfer pads 203 and sub-conductor lines 204. The power pad 201 section is designed to provide power to the heater plate 100 from a power supply. The main power line 202 section is designed to provide power to the heater plate 100 via connecting power pads 201 to the sub-conductor lines 204. The electrical transfer pads 203 section is a connector which electrically connects the conductive layer 102 and resistive layer 103 through resistive layer 103 section resistive transfer pads 205. Sub-conductor lines 204 section is a connector which connects the electrical transfer pads 203 to power pads 201 through the main power lines 202.

Power is applied through power pads 201 and distributed along the main power line 202 and sub-conductor lines 204, respectively. Afterwards, electrical transfer pads 203 carry the power to the resistive transfer pads 205 so that each resistive layer parts first, second, third and fourth portion parts which are in connection with the resistive transfer pads 205 are biased, which means that each resistive transfer pad 205 doesn't localize overheating and prevents the formation of thermal hot spots. The main power lines 202, electrical transfer pads 203, sub-conductor lines 204 connect each resistive part to power pad 201, resulting in a complex combination with resistive parts and of conductive layer 102 sections with small resistivity.

The second layer coated on heating circuit sin ace 105 is the resistive layer 103. The resistive layer 103 is coated directly on the heating circuit surface 105 whereas resistive transfer pads 205 are placed on the electrical transfer pads 203.

Resistive transfer pads 205 and electrical transfer pads 203 are formed to provide contact in order to transfer power to the resistive layer 103. The resistive layer 103 pattern is made from resistive ink and is composed of four portions comprising ten resistive parts. The first resistive portion is the innermost portion which comprises one part with an angle $\alpha=360°-\Delta\theta$. The part is called first portion resistive part 301. The second resistive portion, which encircles first resistive portion, comprises two parts with an angle $\beta=180°-\Delta\theta$. The parts are called second portion resistive parts 302. The third resistive portion, which encircles the second resistive portion, comprises three parts with an angle Y=120°−Δθ, respectively. The parts are called third portion resistive parts 303. The fourth resistive portion, which encircles the third resistive portion, comprises four parts, two of which has an angle of ζ=90°−Δθ. For the remaining two parts of the fourth resistive portion, a little bit smaller angle is assigned due to the spacing of power pads 201. The parts are called fourth portion resistive parts 304. Δθ is defined by the thick film technology, the smallest distance between the separate coating parts. The resistance of the each resistive part is arranged by adjusting the widths to equalize power densities. Resistivities of the resistive layer 103 sections are included during track pattern optimization to benefit from their resistances for heating up.

Figure 2:
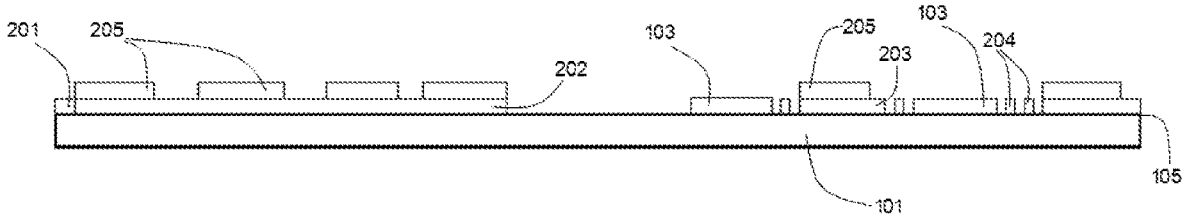
FIG. 2. The vertical cross-section view of the heater in accordance with the invention.
Figure 3:
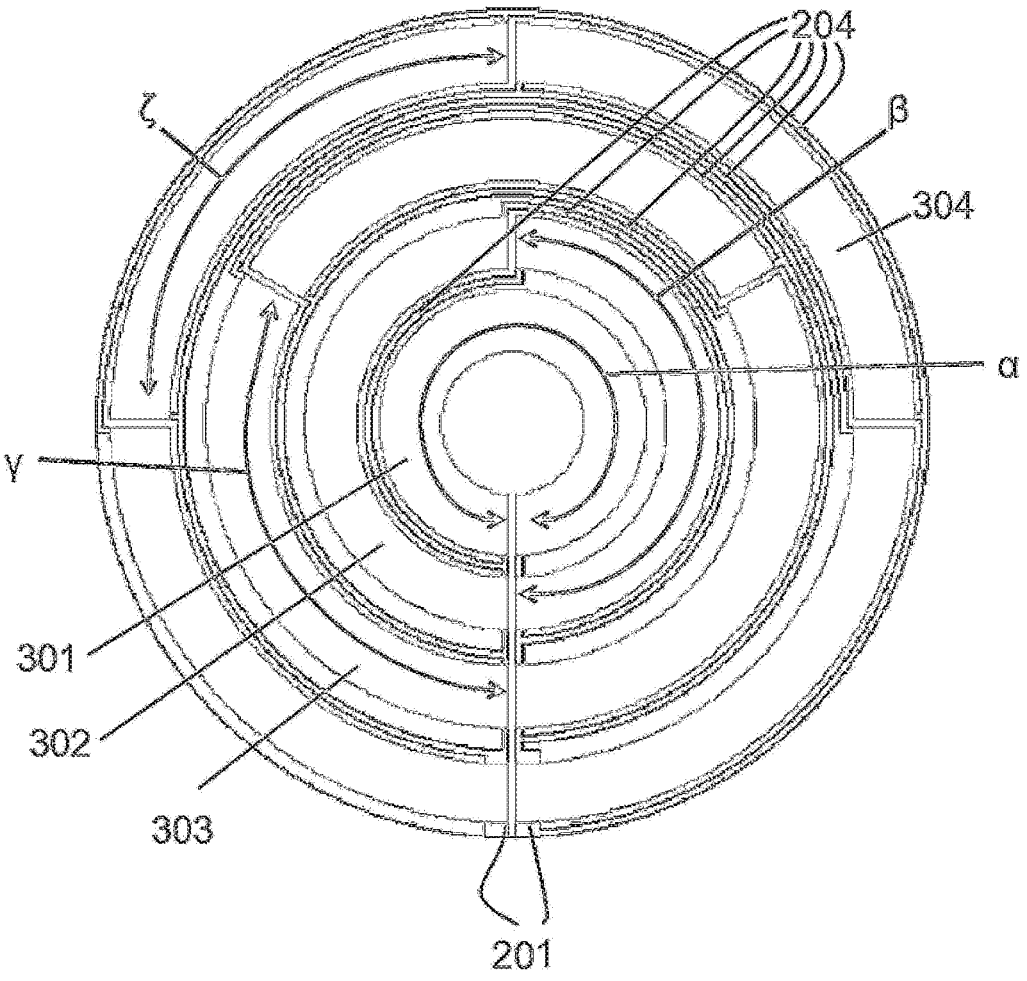
FIG. 3. Top view of the heating circuit pattern.
Figure 4:
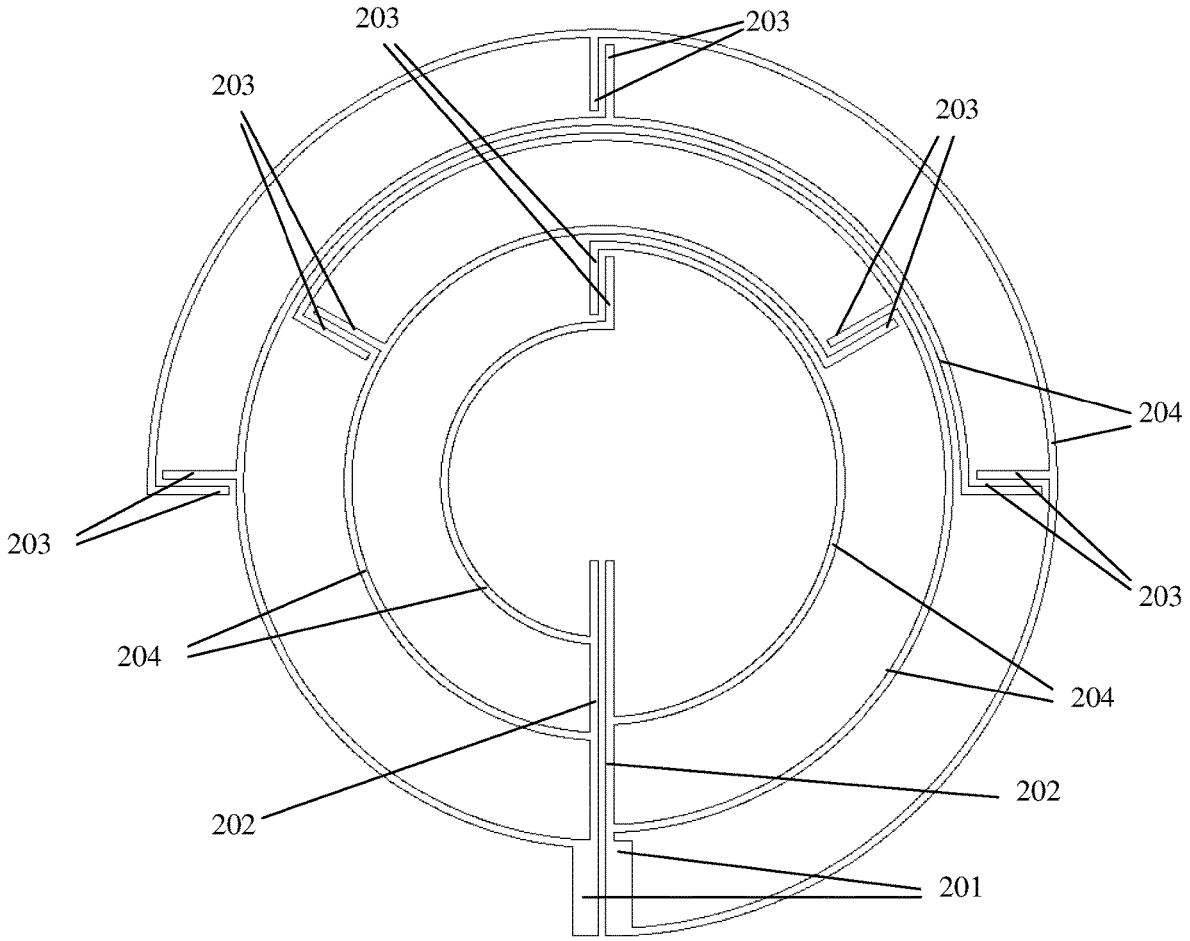
FIG. 4. Top view of the conductive layer.

In the preferred embodiment of the invention, the thickness of the coatings is preferred to be about 20 μm for the implementation of the design. As seen from FIG. 2, thickness on the substrate layer 101 where the electrical transfer pads 203 and resistive transfer pads 205 are overlapped is chosen to be 40 μm. The width of any resistive part depends on the inner and outer diameters. Each width is chosen to distribute equal power densities on resistive parts.

The sub-conductor lines 204 have a pattern such that each pad doesn't localize overheating and prevent formation of thermal hot spots on each resistive part. The distance between sub-conductor lines 204, the sub-conductor lines' 204 width, and the distance between the sub-conductor lines 204 and the resistive parts 301, 302, 303, 304 are all determined by the thick film technology. In the preferred embodiment of the invention, power pads 201 with 0.6 mm length and 1 mm width are for the electrical connection.

To decrease the necessary power and time for heating up, a low mass substrate layer 101 having the thickness between 200-600 micron is chosen. It is much more difficult to get high temperature uniformity on the critical heating surface 104 of the plate with that small mass. In order to accomplish high temperature uniformity in limited time, in the order of seconds, track pattern becomes extremely important and must gather high fill factor providing equal power densities. Regarding these, the overall track pattern is designed as a complex combination of ten resistive parts and their conductor lines 204. Resistive parts whose resistances are determined with width, length, and height and ink resistivity are arranged to provide equal power densities by adjusting their widths. Also sub-conductor line 204 width effects fill factor and determines power densities for sub-conductor lines 204, so width of the sub-conductor lines 204 are also evaluated and optimized carefully. The complex combination results in a fill factor of %76. In addition, since there is no tight turn in the track pattern, "current crowding" is avoided.

To indicate the performance of the present invention, thermal analysis is conducted with Computational Fluid Dynamics CFD approach. The analysis results point out ±4.5° C. temperature difference across the critical heating surface 104 at 205° C. average temperature reached in a few seconds. That low temperature non-uniformity is related to the optimized circuit track pattern with high fill factor. Because of high temperature uniformity of the circuit track pattern, no additional layers are applied over the substrate layer 101, resulting in low heat capacity. This further supports low power and fast warm-up. Moreover, instead of using any further structure for electrical power distribution, conductor layer 102 is placed on the substrate layer 101 as coating. Therefore, the total volume of the design nearly equals to the volume of the substrate layer 101 that allows the present invention to be utilized in low volume. applications.

What is claimed is:

1. A heater plate comprising:

a heater circuit track pattern coated on a substrate layer;

the substrate layer has a thickness between 200 μm to 499 μm and is a bottom layer of the heater plate, wherein the bottom layer is electrically insulative;

wherein the substrate layer is thermally conductive;

wherein the substrate layer has a heat capacity;

wherein the substrate layer has a critical heating surface on one side and a heating circuit surface on another side;

wherein the heater circuit track pattern includes a conductive layer;

wherein the conductive layer is made of a conductive material;

wherein the conductive layer is coated on the heating circuit surface;

wherein the conductive layer has a plurality of power pads, a plurality of main power lines, a plurality of electrical transfer pads, and a plurality of sub-conductor lines;

wherein the plurality of power pads, the plurality of main power lines, the plurality of electric transfer pads, and the plurality of sub conductor lines are made of a conductive material;

wherein the plurality of power pads, the plurality of main power lines, the plurality of electrical transfer pads, and the plurality of sub conductor lines distribute power equally to a resistive layer; wherein the resistive layer is coated on the heating circuit surface;

wherein the resistive layer has a plurality of resistive portions formed by a resistive ink to heat up the heater plate;

wherein the resistive layer and the heater plate provide uniform heat distribution;

wherein the resistive layer prevents a current crowding for the heater plate;

wherein the resistive layer has a first resistive portion, including a first portion resistive part defining a circular arc with a central angle of α=360°−Δθ, and a second resistive portion, encircling the first resistive portion, the second resistive portion including two second portion resistive parts defining a circular arc with a central angle of β=180°−Δθ, wherein Δθ is the smallest distance between the first portion resistive part and the two second portion resistive parts.

2. The heater plate of claim 1, wherein power is applied through the plurality of power pads to the heater plate.

3. The heater plate of claim 1, wherein the plurality of main power lines provides power to the heater plate via the plurality of power pads; wherein the power pads are electrically connected to the electrical transfer pads.

4. The heater plate of claim 1, wherein the plurality of electrical transfer pads electrically connects the conductive layer and the resistive layer through resistive layer section to a plurality of resistive transfer pads.

5. The heater plate of claim 1, wherein the plurality of sub-conductor lines connects the plurality of electrical transfer pads to the plurality of power pads through the plurality of main power lines.

6. The heater plate of claim 1, wherein the plurality of resistive transfer pads connects the plurality of electrical transfer pads to the plurality of resistive parts of the resistive layer.

7. The heater plate of claim 1, further comprising a third resistive portion encircling the second resistive portion, the third resistive portion having three third portion resistive parts defining a circular arc with a central angle of $Y=120°-\Delta\theta$.

8. The heater plate of claim 1, further comprising a fourth resistive portion encircling the third resistive portion, the fourth resistive portion having four fourth portion resistive parts defining a circular arc, wherein two of the four of fourth portion resistive parts have a central angle of $\zeta=90°-\Delta\theta$, and the other two of the four fourth portion resistive parts have a central angle slightly smaller than $\zeta=90°-\Delta\theta$ due to spacing between the plurality of power pads.

9. The heater plate of claim 1, wherein resistances of the plurality of resistive portions are arranged by adjusting the widths to equalize power densities.

10. The heater plate of claim 1, wherein the plurality of main power lines, the plurality of electrical transfer pads, and the plurality of sub-conductor lines connects each of the plurality of resistive parts to the plurality of power pads, resulting in a combination with the plurality of resistive parts and a plurality of conductive layer sections with a resistivity.

11. The heater plate of claim 1, further comprising a combination with the plurality of resistive parts and the conductive layer.

12. The heater plate of claim 11, wherein the combination with the plurality of resistive parts and the conductive layer provides a 76% fill factor.

13. The heater plate of claim 1, wherein portions of the conductive layer have resistances from heating up.

14. The heater plate of claim 2, wherein resistances of the plurality of resistive portions are arranged by adjusting the widths to equalize power densities.

15. The heater plate of claim wherein the plurality of main power lines, the plurality of electrical transfer pads, and the plurality of sub-conductor lines connects each of the plurality of resistive parts to the plurality of power pads, resulting in a combination with the plurality of resistive parts and a plurality of conductive layer sections with a resistivity.

16. The heater plate of claim 2, further comprising a combination with the plurality of resistive parts and the conductive layer.

17. The heater plate of claim 16, wherein the combination with the plurality of resistive parts and the conductive layer provides a 76% fill factor.

18. The heater plate of claim 2, wherein portions of the conductive layer have resistances from heating up.

19. The heater plate of claim 3, wherein resistances of the plurality of resistive portions are arranged by adjusting the widths to equalize power densities.

20. The heater plate of claim 3, wherein the plurality of main power lines, the plurality of electrical transfer pads, and the plurality of sub-conductor lines connects each of the plurality of resistive parts to the plurality of power pads, resulting in a combination with the plurality of resistive parts and a plurality of conductive layer sections with a resistivity.

* * * * *